United States Patent [19]

Szafianski

[11] 4,082,276

[45] Apr. 4, 1978

[54] VENTILATED HANDLE FOR TENNIS RACKETS OR THE LIKE

[76] Inventor: Marius Szafianski, 230 E. 79th St., Apt. 7C, New York, N.Y. 10021

[21] Appl. No.: 709,897

[22] Filed: Jul. 29, 1976

[51] Int. Cl.[2] ..... A63B 49/08

[52] U.S. Cl. ..... 273/75

[58] Field of Search ..... 273/73 R, 73 J, 75, 273/81 R, 162 R, 162 F; 417/411; 43/23; 145/61 R; 74/551.8, 551.9; 15/143 R, 143 B, 144 R; 16/110 R, DIG. 12

[56] References Cited

U.S. PATENT DOCUMENTS

| | | | |
|---|---|---|---|
| 2,222,121 | 11/1940 | Roberts | 273/75 X |
| 2,803,527 | 8/1957 | Lundahl | 417/411 X |
| 2,835,245 | 5/1958 | Morgan | 43/23 X |
| 3,333,834 | 8/1967 | Brewster | 417/411 X |
| 3,645,008 | 2/1972 | Delsack | 273/75 X |
| 3,858,567 | 1/1975 | Slogaski | 43/23 X |
| 3,999,243 | 12/1976 | LaPour | 273/162 F X |

FOREIGN PATENT DOCUMENTS

| | | | |
|---|---|---|---|
| 134,426 | 9/1949 | Australia | 273/75 |

*Primary Examiner*—Richard J. Apley
*Attorney, Agent, or Firm*—Haseltine, Lake & Waters

[57] ABSTRACT

A ventilated handle has a perforated outer shell comprising internal fan powered by integral source of energy to move air through and around the handle to cool and dry moisture due to physical effort.

2 Claims, 5 Drawing Figures

VENTILATED HANDLE FOR TENNIS RACKETS OR THE LIKE

BACKGROUND OF THE INVENTION

This invention relates to the ventilated handle structure for rackets, bats or other devices requiring physical effort. More particularly the invention is directed to a tennis racket handle.

Until now tennis rackets and the like have usually been provided with solid handles, having a although these handles are sometimes equipped with perforations and leather or plastic covering; yet after relatively short time of intense use they become slippery due to sweat and moisture.

This presents a serious problem to any especially when one realizes that normal use was contemplated under extremely hot and humid weather conditions. Victory or defeat under such conditions depends sometimes on one uncontrolled "slip" which could be easily avoided with some improvement in a handle construction.

Some players try to solve this problem by blowing air occasionally upon sweaty, moist handles, others carry small terry cloth sheet at their belt to wipe handles whenever they can.

Both ways apart from aesthetical reasons are highly ineffective and hardly compatible with a concept of modern sport industry.

SUMMARY OF THE INVENTION

The main object of the present invention is to overcome the defects in the prior art.

Another object of the invention is to produce a racket handle having a hollow, perforated outer shell provided with high RPM fan, powered by an integral source of energy.

The present invention contemplates a means for cooling the handle integral therewith. Several energy sources such as electric battery, compressed gas cartridge, stressed steel coil or combustion engine can be used but electric battery seems to fit the best because of its simplicity, quietness, service time etc.

After switch is turned on, a miniature fan starts to suck air into outer shell and then pushes it out through perforation at the grip section of a handle.

This ventilation dries efficiently sweat and moisture on the handle and player's hand providing thus secure and comfortable grip. Although such novel feature or features believed to be characteristic of the invention are pointed out in the claims, the invention and the manner in which it may be carried out, may be further understood by reference to the description following and accompanying drawings.

IN THE DRAWINGS

PREFERRED EMBODIMENT

Figure 1:
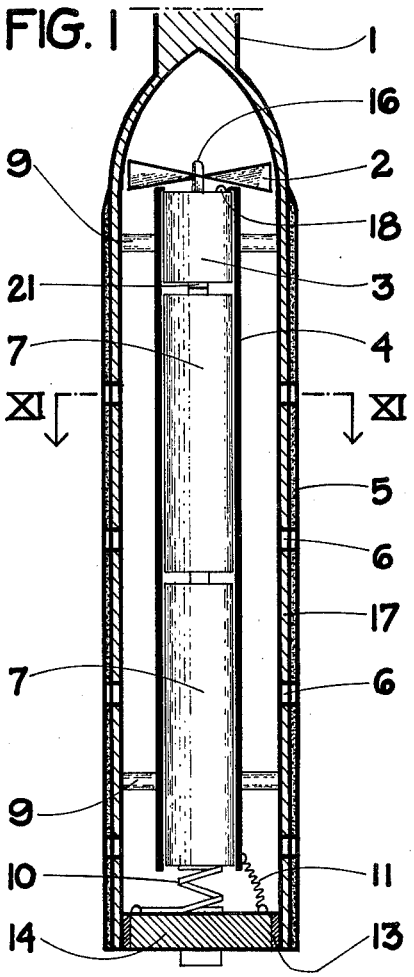
FIG. 1 is a top cross-sectional view of a handle.

The handle 1 comprises fan propeller 2 attached to an axle 16 of an electric motor 3 as shown in FIG. 1.

Electric motor 3 is equipped with a positive terminal 21 and a negative terminal 18.

Electric motor 3 and electric batteries 7 are contained in an inner shell 4 fixed centrically in an outer shell 17 by with supports 9.

The handle 1 structure can be made of metal, plastic, wood or composite material. For variety of reasons such as high strength to weight ratio, ease of manufacturing etc. metals such as, seem to fit the best.

Two 1.5 batteries 7 connected positive to negative are usually sufficient to operate high RPM /3000-5000/ miniature electric motor 3 at 3V for about 2HRS. Spring 10 pushes two batteries 7, motor terminals 18 and 21 together all inside inner, metal tube 4 to assure proper contact between these elements of electric circuit.

Figure 2:
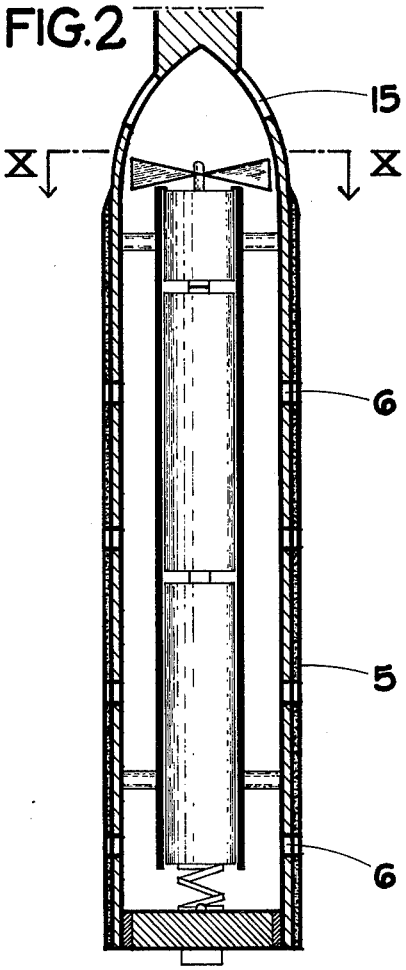
FIG. 2 is a side cross-sectional view of a handle.

The circuit can be closed or opened with switch 14 set in an outer shell 17 with an elastic gasket 13. Spring 10 and connecting wire 11 connect switch 14 to the other components of a circuit mentioned above. When switch 14 is turned on, electric motor motioned propeller 2 sucks air through two suction holes 15 as shown in FIG. 2 and then air is being pushed through holes 6 drilled through outer shell 17 and leather covering 5 wrapped around the outer shell. This ventilating action dries and cools handle and player's hand as well.

Figure 3:
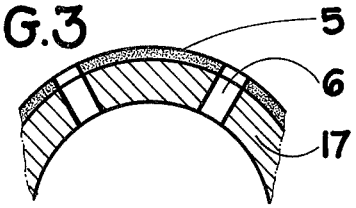
FIG. 3 is an enlarged cross-sectional view of a handle taken along the line 3—3 of FIG. 1.
Figure 4:
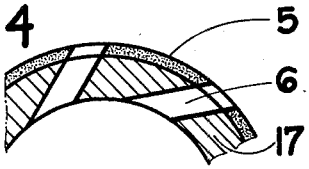
FIG. 4 is an enlarged cross-sectional view of another configuration of perforations taken along the line 3—3 of FIG. 1.

FIG. 3 and FIG. 4 show two different perforation hole configurations.

FIG. 3 shows perforation in the outer shell 17 and leather covering 5 with holes 6 drilled vertically through. These kind of holes are much easier to produce but not as efficient as diagonal holes shown in FIG. 4. Diagonal perforations tend "to wrap around" the handle with circulating air resulting in much more efficient drying action.

Figure 5:
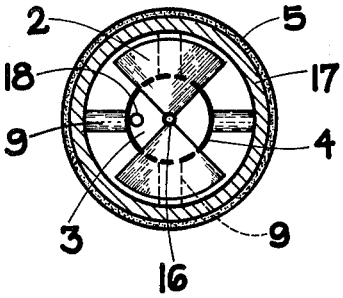
FIG. 5 is a front cross-sectional view taken along the line 5—5 of FIG. 2. Referring now to the figures in greater detail, where like reference numbers denote like parts in the various figures.

FIG. 5 shows cross-sectional front view of the handle 1 construction along the line 5—5 of FIG. 2. The inner shell 4 is fixed centrically inside outer shell 17 with supports 9. Batteries 7 and motor 3 are contained in the inner, metal shell 4. The negative terminal 18 of the motor is connected to the inner shell 4 which at the same time is being used as a conducting element. Propeller 2 is set directly on axle 16 of motor 3. Leather covering 5 is wrapped around outer shell 17 for a comfortable grip.

It is intended that the invention can be applied to many existing handle structures by providing them with entirely novel and unique features.

ALTERNATE EMBODIMENT

In an alternate embodiment of the present invention, the fan can be powered by a gas turbine with compressed gas cartridge as a source of energy, or the whole configuration can be turned up side down e.g. fan at the bottom and switch in the upper section of a handle. It is also understood that my invention can be applied to any device or tool requiring physical effort such as hammers, screw drivers etc.

Many modifications and variations of the present invention are possible in light of the above teachings. It is, therefore, to be understood that within the scope of the appended claims, the invention may be practiced otherwise than as particularly described.

Having thus described certain forms of the invention in some detail what is claimed is:

1. A handle for use with a tennis racket or the like requiring physical effort, employing ventilation system integral with said handle, said ventilation system being defined by: energizing means disposed within an interior chamber forming a portion of said handle; an outer covering of said handle defined by a plurality of perforations; said perforations being formed as continuous passages extending from said interior portion to said outer covering and air moving means associated with said energizing means for moving air through and around said perforations at said outer covering.

2. A handle according to claim 1 wherein: said ventilation system being disposed in an interior chamber of said handle comprising: an outer covering spaced from said chamber, with suction holes disposed thereabout; and said air moving means being defined by a high RPM fan actuated by an associated switch means in operational relationship therewith through a source of energy, air intake ports formed in a frame of said handle in proximity to said fan, and exhaust means for receiving moving air generated by said fan.

* * * * *